US007311139B2

(12) United States Patent
Kern et al.

(10) Patent No.: US 7,311,139 B2
(45) Date of Patent: Dec. 25, 2007

(54) HEAT EXCHANGER

(75) Inventors: Robert D. Kern, Waukesha, WI (US); Guoming Wu, Waukesha, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 120 days.

(21) Appl. No.: 11/201,989

(22) Filed: Aug. 11, 2005

(65) Prior Publication Data

US 2007/0034362 A1 Feb. 15, 2007

(51) Int. Cl.
*F28F 3/04* (2006.01)

(52) U.S. Cl. ..... 165/163; 165/916; 165/166

(58) Field of Classification Search ..... 165/163, 165/166, 167, 916
See application file for complete search history.

(56) References Cited

U.S. PATENT DOCUMENTS

| | | | | | |
|---|---|---|---|---|---|
| 3,258,832 | A | | 7/1966 | Gerstung | |
| 3,341,925 | A | | 9/1967 | Gerstung | |
| 4,002,201 | A | | 1/1977 | Donaldson | |
| 4,011,905 | A | | 3/1977 | Millard | |
| 4,249,597 | A | | 2/1981 | Carey | |
| 4,293,033 | A | * | 10/1981 | Nasser | 165/166 |
| 4,470,455 | A | | 9/1984 | Sacca | |
| 4,696,342 | A | | 9/1987 | Yamauchi et al. | |
| 4,932,469 | A | | 6/1990 | Beatenbough | |
| 5,050,671 | A | | 9/1991 | Fletcher | |
| 5,392,849 | A | | 2/1995 | Matsunaga et al. | |
| 5,462,113 | A | * | 10/1995 | Wand | 165/167 |
| 5,692,559 | A | | 12/1997 | Cheong | |
| 5,988,269 | A | * | 11/1999 | Karlsson et al. | 165/167 |
| 6,016,865 | A | * | 1/2000 | Blomgren | 165/148 |
| 6,180,846 | B1 | * | 1/2001 | Dandekar et al. | 585/443 |
| 6,305,466 | B1 | * | 10/2001 | Andersson et al. | 165/140 |

* cited by examiner

*Primary Examiner*—Teresa J. Walberg
(74) *Attorney, Agent, or Firm*—Boyle Fredrickson S.C.

(57) ABSTRACT

A heat exchanger is provided for dissipating heat from a fluid. The heat exchanger includes a plurality of stacked pairs of plates. Each pair of plates includes a first plate and a second plate. The first plate extends along a first axis and has first and second sides. The first side of the first plate has a generally sinusoidal recess therein that extends along the first axis. The second plate extends along a second axis and has first and second sides. The first side of the second plate has a generally sinusoidal recess therein that extends along the second axis and that is out of phase with the sinusoidal recesses in the first side of the first plate. The first side of the first plate and the first side of the second plate form a mating relationship with each other such that the recess in the first side of the first plate communicates with the recess in the first side of the second plate at a plurality of axially spaced locations.

20 Claims, 4 Drawing Sheets

HEAT EXCHANGER

FIELD OF THE INVENTION

This invention relates generally to engine driven electrical generators, and in particular, to a heat exchanger for cooling engine oil flowing therethrough.

BACKGROUND AND SUMMARY OF THE INVENTION

As is known, heat exchangers are used in a wide variety of applications in order to heat and/or cool the liquids and/or the gases flowing therethrough. In a plate-type heat exchanger, a plurality of pairs of relatively flat, heat exchange plates are stacked together. Each plate has an inlet port at one end, and an outlet port at the opposite end. A fluid passageway interconnects the inlet port and the outlet port and distributes the flow of fluid over the surface of the plate. The individual plates of a pair of plates are orientated such that the inlet ports and the outlet ports are aligned and such that the fluid passageways overlap and communicate. The outer periphery of the individual plates of a pair of plates are sealed in a fluid tight relationship so as to maintain fluid flowing within the fluid passageways. The pairs of plates are stacked upon each other to form the heat exchanger and inlet and outlet nipples are mounted to the heat exchanger to allow for the flow of fluid therethrough. In operation, it can be appreciated that air is allowed to pass transversely through the heat exchanger between plate pairs in order to cool the fluid passing through the heat exchanger.

An example of a prior plate heat exchanger is disclosed in Cheong, U.S. Pat. No. 5,692,559. The Cheong '559 patent discloses a stacked plate heat exchanger with a plurality of stacked plate pairs. Each plate pair includes first and second plates having peripheral portions joined together and central planar portions spaced apart each defining a fluid passage therebetween. Each plate pair has a spaced apart inlet and outlet opening which are openings connected together for the flow of fluid through the fluid passages. Central planar portions have obliquely orientated, parallel ribs formed therein. The ribs are arranged asymmetrically on each plate of a plate pair so that in back-to-back plates of adjacent plate pairs, each rib on one plate contacts no more than two ribs on the adjacent plate of the back-to-back plates.

While its manufacturability has been improved compared to those produced in the past, the plate heat exchanger disclosed in the Cheong '559 patent still requires stacking the embossed plates accurately so that the upstream and downstream on adjacent plates can be connected correctly to form the fluid flow passage. As such, the heat exchanger performance is sensitive to manufacturing equipment and process variation that directly impacts the manufacturing cost. Therefore, it can be appreciated that a heat exchanger which can use low manufacturing equipment and tolerate process variations without affecting part performance would be highly desirable.

Therefore it is a primary object and feature of the present invention to provide a plate heat exchanger that is simple to assemble and inexpensive to manufacture.

It is a further object and feature of the present invention to provide a plate heat exchanger with stronger cooling air turbulence between adjacent pairs of plates that more effectively effectuates the heat exchanger between the fluid flowing therethrough and the air flowing therepast.

It is a still further object and feature of the present invention to provide a plate heat exchanger that overcomes the shortcomings of prior units.

In accordance with the present invention, a heat exchanger is provided for dissipating heat from a fluid. The heat exchanger includes a plurality of stacked pairs of plates. Each pair of plates includes a first plate and a second plate. The first plate extends along a first axis and has first and second sides. The first side of the first plate has a generally sinusoidal recess therein that extends along the first axis. The second plate extends along a second axis and has first and second sides. The first side of the second plate has a generally sinusoidal recess therein that extends along the second axis and that is out of phase with the sinusoidal recesses in the first side of the first plate. The first side of the first plate and the first side of the second plate form a mating relationship with each other.

The recess in the first side of each first plate communicates with the recess in the first side of the second plate at a plurality of axially spaced locations. The first plate of each pair of plates includes a first aperture extending between the first and second sides of the first plate and communicating with a first end of the recess in the first side of the first plate. The first plate of each pair of plates also includes a second aperture extending between the first and second sides of the first plate and communicating with a second end of the recess in the first side of the first plate. The second plate of each pair of plates includes a first aperture extending between the first and second sides of the second plate and communicating with a first end of the recess in the first side of the second plate. In addition, the second plate of each pair of plates includes a second aperture extending between the first and second sides of the second plate and communicating with a second end of the recess in the first side of the second plate. The first apertures in the first and second plates of the plurality of stacked pairs of plates define a first fluid passageway in the heat exchanger and the second apertures in the first and second plates of the plurality of stacked pairs of plates define a second fluid passageway in the heat exchanger. A first nipple communicates with the first fluid passageway for interconnecting the heat exchanger to a fluid source and a second nipple communicates with the second fluid passageway for interconnecting the heat exchanger to the fluid source.

In accordance with a further aspect of the present invention, a heat exchanger is provided for dissipating heat of a fluid. The heat exchanger includes first and second plates. The first plate extends along a first axis and has first and second sides. The first side of the first plate has a recess formed therein that extends along the first axis and that has a configuration corresponding to a first waveform. The second plate extends along a second axis and has a first side that forms a mating relationship with a first side of the first plate and a second side. The first side of the second plate has a recess formed therein that extends along the second axis and that has a configuration corresponding to a second waveform. The recess in the first plate and the recess in the second plate communicate at a plurality of axially spaced locations.

It is contemplated for the first waveform of the recess in the first plate to have a generally sinusoidal configuration and for the second waveform of the recess in the second plate to have a generally sinusoidal configuration. The first waveform of the recess in the first plate is out of phase with the second waveform of the recess in the second plate.

The first plate includes a first aperture extending between the first and second sides of the first plate and communicating with a first end of the recess in the first side of the first plate. The first plate also includes a second aperture extending between the first and second sides of the first plate and communicating with a second end of the recess in the first side of the first plate. The second plate includes a first aperture extending between the first and second sides of the second plate and communicating with a first end of the recess in the first side of the second plate. In addition, the second plate includes a second aperture extending between the first and second sides of the second plate and communicating with a second end of the recess in the first side of the second plate. The first apertures in the first and second plate define a first fluid passageway in the heat exchanger and the second apertures in the first and second plates define a second fluid passageway in the heat exchanger. A first nipple communicates with the first fluid passageway for interconnecting the heat exchanger to a fluid source and a second nipple communicates with the second fluid passageway for interconnecting the heat exchanger to the fluid source.

In accordance with a still further aspect of the present invention, a heat exchanger is provided for dissipating heat from a fluid. The heat exchanger includes a plurality of stacked pairs of plates. Each pair of plates includes first and second plate. The first plate extends along a first axis and has first and second sides. The first side of the first plate having a recess therein that extends along the first axis. A first aperture extends between the first and second sides of the first plate and communicates with a first end of the recess in the first side of the first plate. A second aperture extends between the first and second sides of the first plate and communicates with a second end of the recess in the first side of the first plate. The second plate extending along a second axis and has first and second sides. The first side of the second plate forms a mating relationship with the first side of the first plate and has a recess therein that extends along the second axis and communicates with the recess in the first side of the first plate at a plurality of axially spaced locations. A first aperture extends between the first and second sides of the second plate and communicates with a first end of the recess in the first side of the second plate. A second aperture extends between the first and second sides of the second plate and communicates with a second end of the recess in the first side of the second plate.

The recess in the first side of the first plate has a configuration corresponding to a first waveform and the recess in the first side of the second plate has a configuration corresponding to a second waveform. The first and second waveforms are generally sinusoidal and the first waveform is out of phase with the second waveform.

The first apertures in the first and second plates partially define a first fluid passageway in the heat exchanger and the second apertures in the first and second plates partially define a second fluid passageway in the heat exchanger. A first nipple communicates with the first fluid passageway to interconnect the heat exchanger to a fluid source. A second nipple communicates with the second fluid passageway to interconnect the heat exchanger to the fluid source.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
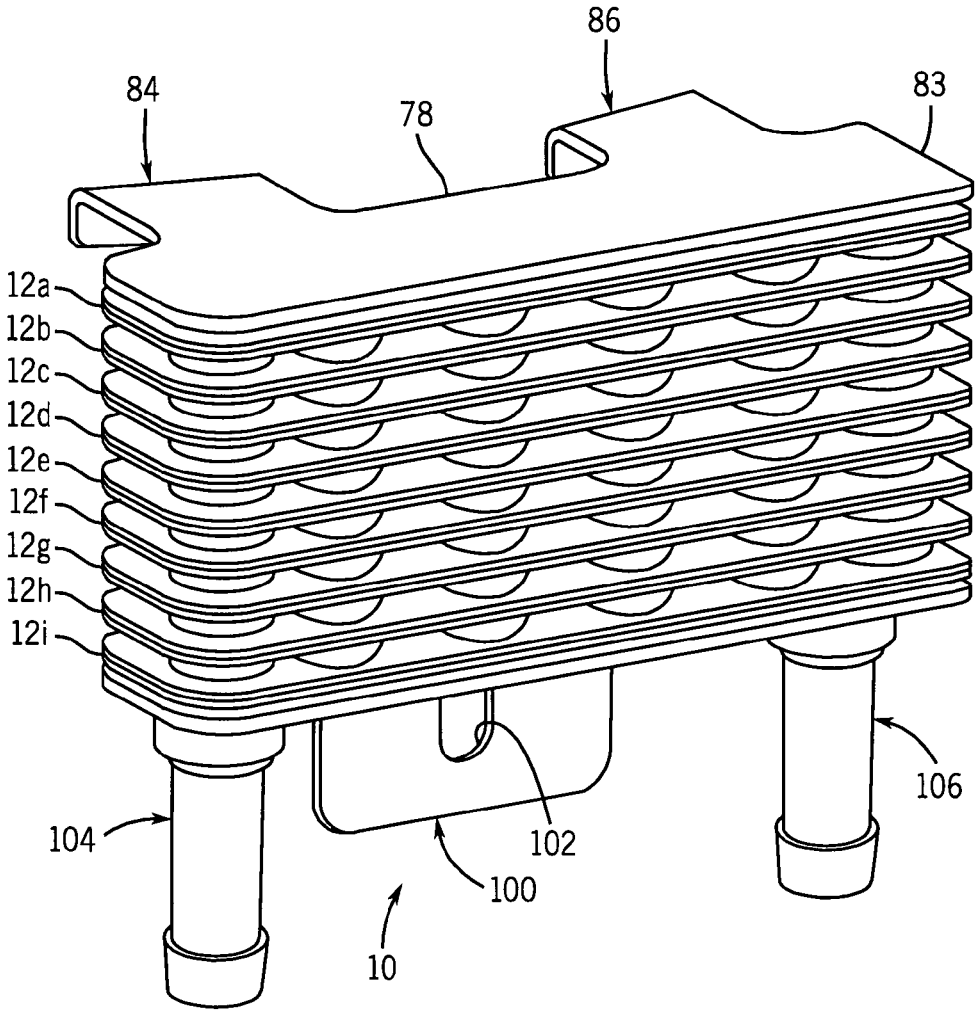
FIG. 1 is a front, isometric view of a heat exchanger in accordance with a present invention.
Figure 2:
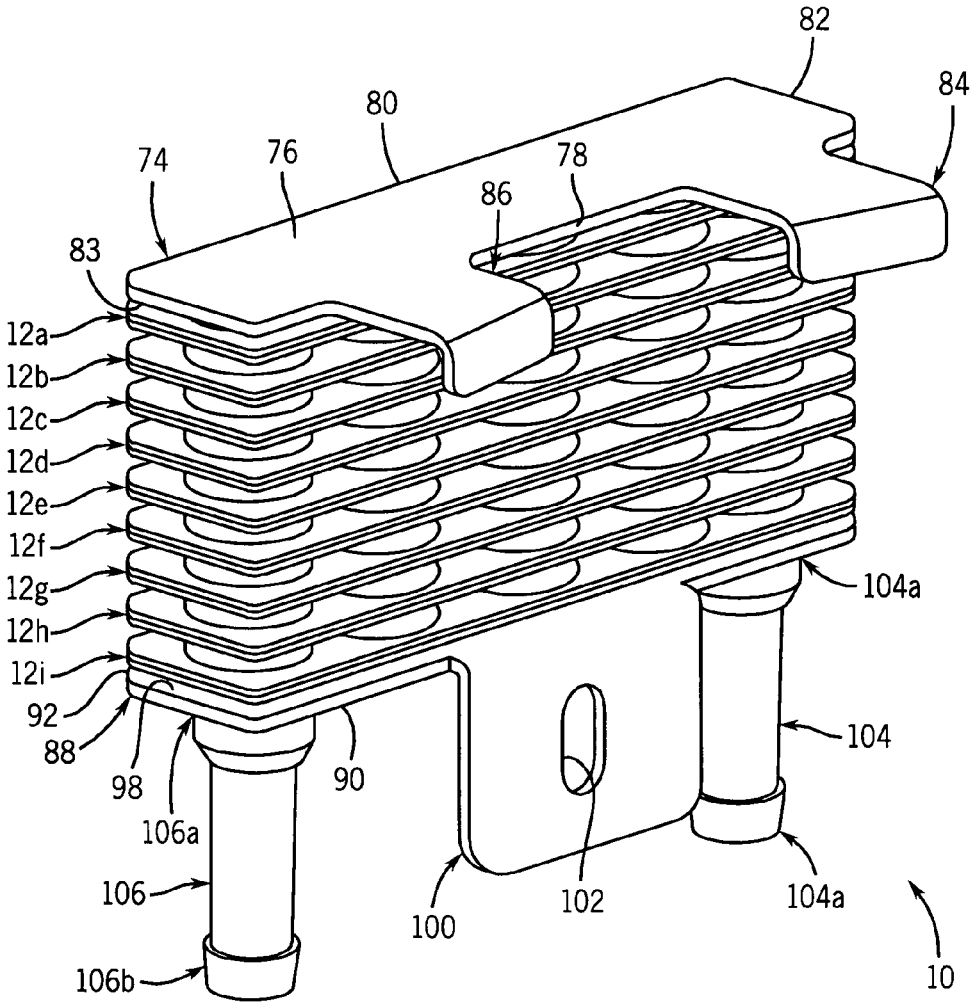
FIG. 2 is a rear, isometric view of the heat exchanger of FIG. 1.
Figure 3:
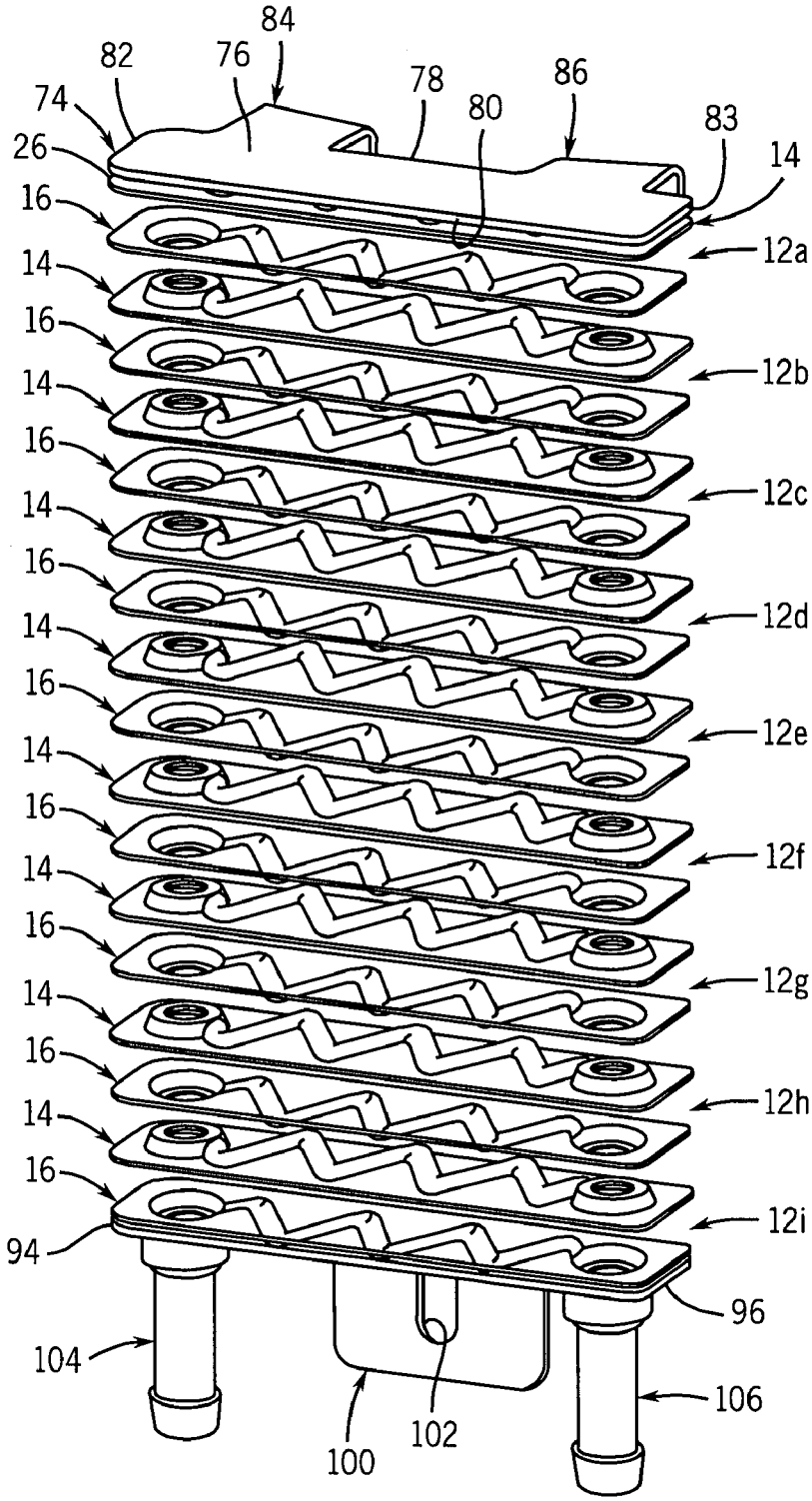
FIG. 3 is an exploded, isometric view of the heat exchanger of FIG. 1.
Figure 4:
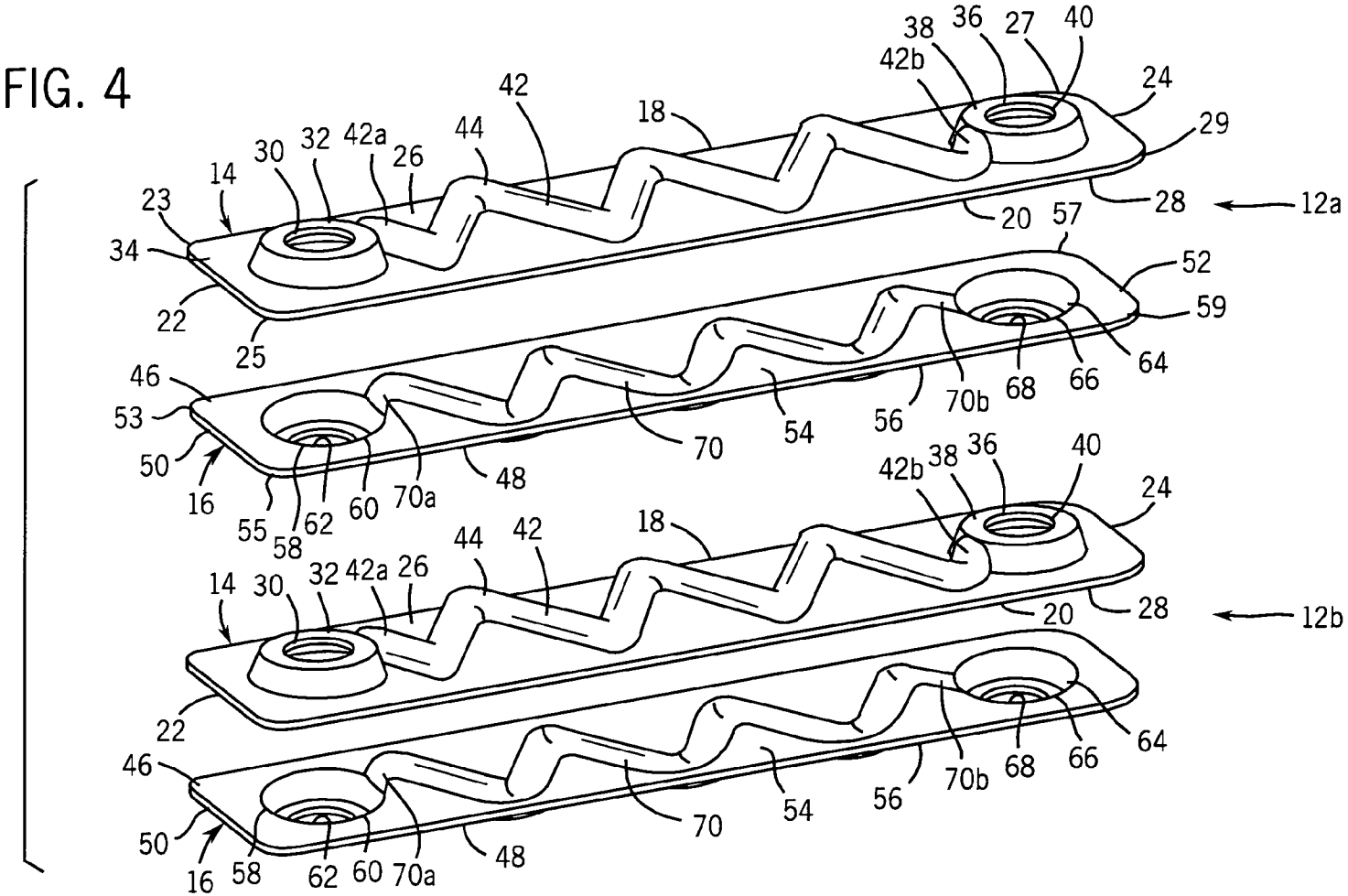
FIG. 4 is an exploded, isometric view showing first and second pairs of plates for the heat exchanger of FIG. 1.

Referring to FIGS. 1-4, a heat exchanger in accordance with the present invention is generally designated by the reference numeral 10. Heat exchanger 10 includes a plurality of stacked pair plates 12*a*-12*i*. Each pair of plates 12*a*-12*i* is identical in structure, and as such, the description hereinafter of plate pair 12*a* is understood to described each of the other pairs of plates 12*b*-12*i* as if fully described hereinafter. As best seen in FIGS. 3-4, plate pair 12*a* includes upper plate 14 and lower plate 16. Upper plate 14 extends along a longitudinal axis and is defined by first and second sides 18 and 20, respectively, and first and second ends 22 and 24, respectively. First and second sides 18 and 20, respectively, intersect first end 22 of upper plate 14 at corresponding corners 23 and 25, respectively, having predetermined radii. First and second sides 18 and 20, respectively intersect second end 24 at corresponding corners 27 and 29, respectively, having radii that differ from the radii of corners 23 and 25 in order to facilitate assembly heat exchanger 10 as hereinafter described. Upper plate 14 is further defined by an upper surface 26 and a lower surface 28.

First recess 30 is provided in lower face 28 of upper plate 14 and terminates at wall 32. Wall 32 includes central opening 34 therein, for reasons hereinafter described. In the contemplated embodiment, first recess 30 is positional adjacent first end 22 of upper plate 14. Lower surface 28 of upper plate 14 further includes second recess 36 adjacent second end 24 of upper plate 14. Second recess 36 in lower surface 28 of upper plate 14 terminates at wall 38 having central opening 40 extending therethrough.

A generally sinusoidal flow channel 42 is provided in lower surface 28 of upper plate 14. Flow channel 42 includes first end 42*a* that communicates with the cavity defined by first recess 30 adjacent first end 22 of upper plate 14 and second end 42*b* that communicates with the cavity defined by second recess 36 adjacent second end 24 of upper plate 14. Flow channel 42 in lower surface 28 of upper plate 14 corresponds to rib 44 projecting from upper surface 26 of upper plate 14.

Lower plate 16 of plate pair 12*a* extends a longitudinal axis generally parallel to the longitudinal axis of upper plate 14 and is defined by first and second sides 46 and 48, respectively, and first and second ends 50 and 52, respectively. First and second sides 46 and 48, respectively, of lower plate 16 intersect first end 50 thereof at corresponding corners 53 and 55, respectively, having predetermined radii. First and second sides 46 and 48, respectively, intersect second end 52 at corresponding corners 57 and 59, respectively, having predetermined radii that differ from the radii of corners 53 and 55 in order to facilitate assembly of heat exchanger 10 as hereinafter described. Lower plate 16 is further defined by upper surface 54 and lower surface 56. For reasons hereinafter described, it is noted that the dimensions of upper plate 14 and lower plate 16 are identical.

Lower plate 16 includes first recess 58 adjacent first end 50 thereof. First recess 58 terminates at wall 60 and includes central opening 62 therein, for reasons hereinafter described. Lower plate 16 further includes second recess 64 in upper surface 54 adjacent second end 52 thereof. Second recess 64 in upper surface 54 of lower plate 16 terminates at wall 66 having central opening 68 extending therethrough.

Lower plate 16 of plate pair 12*a* further includes a generally sinusoidal flow channel 70 in upper surface 54 thereof. Flow channel 70 extends along the longitudinal axis of lower plate 16 and includes first end 70*a* communicating with the cavity defined by first recess 60 adjacent first end 50 of lower plate 16 and second end 70*b* communicating with the cavity defined by second recess 66 adjacent second end 52 of lower plate 16.

In order to form plate pair 12*a*, upper plate 14 and lower plate 16 are positioned adjacent one another such that lower face 28 of upper plate 14 engages upper face 54 of lower plate 16 and such that sides 18 and 20 of upper plate 14 are aligned with corresponding sides 46 and 48 of lower plate 16 and first and second ends 22 and 24, respectively of upper plate 14 are aligned with corresponding first and second ends 50 and 52, respectively, of lower plate 16. In addition, central opening 34 in wall 32 of upper plate 14 is axially aligned with central opening 62 in wall 60 of lower plate 16 and central opening 40 in wall 38 of upper plate 14 is axially aligned with central opening 68 in wall 66 of lower plate 16. Upper and lower plates 14 and 16, respectively, are joined together in any conventional manner such as by braising, welding, soldering or the like.

Figure 5:
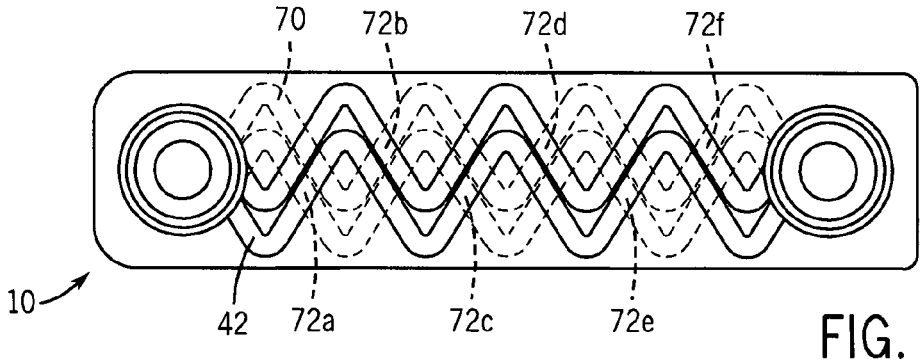
FIG. 5 is a schematic, top plan view of the heat exchanger of the present invention.

Referring to FIG. 5, flow channel 42 in lower surface 28 of upper plate 14 is out of phase with flow channel 70 in upper face 54 with lower plate 16. As a result, flow channel 42 in upper plate 14 communicates with flow channel 70 by a plurality of fluid passageways 72*a*-72*f* axially spaced within each pair of plates 12*a*-12*i*. This arrangement facilitates the cooling of the fluid passing through flow channels 42 and 70, as hereinafter described.

In order to assemble heat exchanger 10, plate pairs 12*a*-12*i* are stacked as depicted in FIGS. 1-2, such that all of the openings 34 in upper plates 14 and all of the openings 62 in lower plates 16 of plate pairs 12*a*-12*i* are in registry and such that all of the openings 40 in upper plates 14 and all of the openings 68 in lower plates 16 of plate pairs 12*a*-12*i* are in registry. It is noted that each upper plate 14 is aligned with lower plate 16 such that corner 23 of plate 14 overlaps corner 53 of plate 16 and such that corner 25 of plate 14 overlaps corner 55 of plate 16. It can be appreciated the difference in radii between corners 23 and 25 on first end 22 of upper plate 14 and corners 27 and 29 on second end 24 of upper plate 14 and the difference in radii between corners 53 and 55 on first end 50 of lower plate 16 and corners 57 and 59 on second end 52 of lower plate 16 facilitates alignment of plates 14 and 16 of each plate pair 12*a*-12*i* and assures that each plate pair 12*a*-12*i* is assembled correctly. Mounting bracket 74 is joined to upper face 26 of upper plate 14 of plate pair 12*a* so as to close openings 30 and 40 in upper plate 14 of plate pair 12*a*. As depicted, mounting bracket 74 includes a generally flat upper surface 76 and is defined by first and second sides 78 and 80, respectively, which overlap corresponding first and second sides 18 and 20, respectively, of upper plate 14, and by first and second ends 82 and 83, which overlap corresponding first and second ends 22 and 24, respectively, of upper plate 14. First and second mounting hooks 84 and 86, respectively, project laterally from side 78 of mounting plate 74 to facilitate the mounting of heat exchanger 10 at the user desired location.

Heat exchanger 10 further includes a lower mounting bracket generally designated by the reference numeral 88. Lower mounting bracket 88 is defined by first and second sides 90 and 92, respectively, which are in registry with corresponding sides 46 and 48, respectively, of lower plate 16 of plate pair 12*i* and by first and second ends 94 and 96, respectively, which are aligned with corresponding first and second ends 50 and 52, respectively, of lower plate 16 of plate pair 12*i*. Upper surface 98 of lower mounting bracket 88 is joined to lower surface 56 of lower plate 16 of plate pair 12*h* in any conventional manner. It is contemplated to provide openings (not shown) in lower mounting bracket 88 that are axially aligned with corresponding openings 62 and 68 in lower plate 16 of plate pair 12*i*. Mounting bracket 88 may also include a mounting flange 100 depending from first side 90 thereof. Mounting flange 100 may include a central aperture 102 to facilitate the mounting of heat exchanger 10 at a user desired location.

Heat exchanger 10 further includes first and second hollow nipples 104 and 106, respectively. Nipple 104 has a first end 104*a* aligned with and communicating with opening 62 in lower plate 16 of plate pair 12*i* and a second opposite end 104*b* connectable to a fluid source. Similarly, nipple 106 has a first end 106*a* aligned with and in communication with opening 68 in lower plate 16 of plate pair 12*i* and a second end 106*b* connectable to the fluid source.

In operation, fluid flows from the fluid source into one of the nipples 104 and 106. By way of example, nipple 104 shall hereinafter be defined as the inlet nipple and nipple 106 as the outlet nipple. However, it can be appreciated that either nipple 104 or 106 may act as the inlet nipple or the outlet nipple without deviating from the scope of the present invention. Fluid flows through inlet nipple 104 under pressure into the passageway of heat exchanger 10 defined by openings 30 in upper plate 14 of plate pairs 12*a*-12*i* and by openings 62 in lower plates 16 of plate pairs 12*a*-12*i*. Thereafter, the fluid flows through flow channels 42 and 70 in plate pairs 12*a*-12*i* to the passageway in heat exchanger 10 defined by openings 40 in upper plate 14 of plate pairs 12*a*-12*i* and by openings 68 in lower plates 16 of plate pairs 12*a*-12*i*. The fluid then flows from heat exchanger 10 through outlet nipple 106 back to fluid source.

It can be appreciated that as the fluid flows through flow channel 42 and flow channel 70 in each plate pair 12*a*-12*i*, the fluid is free to mix and cross into the other of the flow channels through fluid passageways 72*a*-72*f*. As fluid flows through plate pairs 12*a*-12*i*, air flowing over the upper surfaces 26 of upper plates 14 of plate pairs 12*a*-12*i*, lower surfaces 56 of lower plates 16 of plate pairs 12*a*-12*h* so as to effectuate a heat exchange with the fluid flowing through flow channels 42 and 70 of plate pairs 12*a*-12*i* thereby cooling the fluid flowing therethrough. As such, the cooled fluid is returned to the fluid source.

Various modes of carrying out the invention are contemplated as being within the scope of the following claims particularly pointing out and distinctly claiming the subject matter which is regarded as the invention.

We claim:

1. A heat exchanger for dissipating heat from a fluid, comprising:

a plurality of stacked pairs of plates, each pair of plates including:

a first plate extending along a first axis and having first and second sides, the first side of the first plate having a generally sinusoidal recess therein that extends along the first axis; and a second plate extending along a second axis and having first and second sides, the first side of the second plate having a generally sinusoidal recess therein that extends along the second axis and that is out of phase with the sinusoidal recesses in the first side of the first plate;

wherein:

the first side of the first plate and the first side of the second plate form a mating relationship with each other; and the first side of the first plate and the first side of the second plate defining a plurality of axially spaced openings that allow the recess in the first side of the first plate to communicate with the recess in the first side of the second plate.

2. The heat exchanger of claim 1 wherein the first plate of each pair of plates includes a first aperture extending between the first and second sides of the first plate and communicating with a first end of the recess in the first side of the first plate and wherein the first plate of each pair of plates includes a second aperture extending between the first and second sides of the first plate and communicating with a second end of the recess in the first side of the first plate.

3. The heat exchanger of claim 2 wherein the second plate of each pair of plates includes a first aperture extending between the first and second sides of the second plate and communicating with a first end of the recess in the first side of the second plate and wherein the second plate of each pair of plates includes a second aperture extending between the first and second sides of the second plate and communicating with a second end of the recess in the first side of the second plate.

4. The heat exchanger of claim 3 wherein the first apertures in the first and second plates of the plurality of stacked pairs of plates define a first fluid passageway in the heat exchanger.

5. The heat exchanger of claim 4 wherein the second apertures in the first and second plates of the plurality of stacked pairs of plates define a second fluid passageway in the heat exchanger.

6. The heat exchanger of claim 4 further comprising a first nipple communicating with the first fluid passageway for interconnecting the heat exchanger to a fluid source and a second nipple communicating with the second fluid passageway for interconnecting the heat exchanger to the fluid source.

7. A heat exchanger for dissipating heat from a fluid, comprising:

a first plate extending along a first axis and having first and second sides, the first side of the first plate having a recess formed therein that extends along the first axis and that has a first waveform configuration; and a second plate extending along a second axis and having a first side that forms a mating relationship with a first side of the first plate and a second side, the first side of the second plate having a recess formed therein that extends along the second axis and that has a second waveform configuration;

wherein the first side of the first plate and the first side of the second plate defining a plurality of axially spaced openings that allow the recess in the first side of the first plate to communicate with the recess in the first side of the second plate.

8. The heat exchanger of claim 7 wherein the first waveform of the recess in the first plate has a generally sinusoidal configuration and wherein the second waveform of the recess in the second plate has a generally sinusoidal configuration.

9. The heat exchange of claim 7 wherein the first waveform of the recess in the first plate is out of phase with the second waveform of the recess in the second plate.

10. The heat exchanger of claim 7 wherein the first plate of each pair of plates includes a first aperture extending between the first and second sides of the first plate and communicating with a first end of the recess in the first side of the first plate and wherein the first plate of each pair of plates includes a second aperture extending between the first and second sides of the first plate and communicating with a second end of the recess in the first side of the first plate.

11. The heat exchanger of claim 10 wherein the second plate of each pair of plates includes a first aperture extending between the first and second sides of the second plate and communicating with a first end of the recess in the first side of the second plate and wherein the second plate of each pair of plates includes a second aperture extending between the first and second sides of the second plate and communicating with a second end of the recess in the first side of the second plate.

12. The heat exchanger of claim 11 wherein the first apertures in the first and second plates partially define a first fluid passageway in the heat exchanger.

13. The heat exchanger of claim 12 wherein the second apertures in the first and second plates partially define a second fluid passageway in the heat exchanger.

14. The heat exchanger of claim 13 further comprising a first nipple communicating with the first fluid passageway for interconnecting the heat exchanger to a fluid source and a second nipple communicating with the second fluid passageway for interconnecting the heat exchanger to the fluid source.

15. The heat exchanger of claim 7 wherein the first and second plates include an alignment structure for aligning the first and second plates with respect to one another.

16. A heat exchanger for dissipating heat from a fluid, comprising:

a plurality of stacked pairs of plates, each pair of plates including:

a first plate extending along a first axis and having:

first and second sides, the first side of the first plate having a recess therein that extends along the first axis;

a first aperture extending between the first and second sides of the first plate and communicating with a first end of the recess in the first side of the first plate; and a second aperture extending between the first and second sides of the first plate and communicating with a second end of the recess in the first side of the first plate;

a second plate extending along a second axis and having:

first and second sides, the first side of the second plate forming a mating relationship with the first side of the first plate and having a recess therein that extends along the second axis;

a first aperture extending between the first and second sides of the second plate and communicating with a first end of the recess in the first side of the second plate; and a second aperture extending between the first and second sides of the second plate and communicating with a second end of the recess in the first side of the second plate;

wherein the first side of the first plate and the first side of the second plate defining a plurality of axially spaced openings that allow the recess in the first side of the first plate to communicate with the recess in the first side of the second plate.

17. The heat exchanger of claim 16 wherein the recess in the first side of the first plate has a configuration corresponding to a first waveform.

18. The heat exchanger of claim 17 wherein the recess in the first side of the second plate has a configuration corresponding to a second waveform.

19. The heat exchanger of claim 18 wherein the first and second waveforms are generally sinusoidal and wherein the first waveform is out of phase with the second waveform.

20. The heat exchanger of claim 16 wherein:

the first apertures in the first and second plates partially define a first fluid passageway in the heat exchanger;

the second apertures in the first and second plates partially define a second fluid passageway in the heat exchanger;

a first nipple communicating with the first fluid passageway for interconnecting the heat exchanger to a fluid source; and a second nipple communicating with the second fluid passageway for interconnecting the heat exchanger to the fluid source.

* * * * *